US011913766B2

(12) United States Patent
Prisbell et al.

(10) Patent No.: US 11,913,766 B2
(45) Date of Patent: Feb. 27, 2024

(54) SHAPED CHARGE INTEGRATED CANISTER

(71) Applicant: Schlumberger Technology Corporation, Sugar Land, TX (US)

(72) Inventors: Andrew Prisbell, Sugar Land, TX (US); Atsushi Nakano, Sugar Land, TX (US); Terry Butler, Alvin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/654,336

(22) Filed: Mar. 10, 2022

(65) Prior Publication Data

US 2022/0290960 A1 Sep. 15, 2022

Related U.S. Application Data

(60) Provisional application No. 63/160,426, filed on Mar. 12, 2021.

(51) Int. Cl.

| | |
|---|---|
| ***F42B 1/028*** | (2006.01) |
| ***E21B 43/117*** | (2006.01) |
| ***F42D 1/02*** | (2006.01) |
| ***F42D 1/04*** | (2006.01) |
| ***E21B 43/119*** | (2006.01) |

(52) U.S. Cl.

CPC ..... *F42D 1/02* (2013.01); *E21B 43/117* (2013.01); *E21B 43/119* (2013.01); *F42B 1/028* (2013.01); *F42D 1/04* (2013.01)

(58) Field of Classification Search

CPC .... F42B 1/028; F42B 1/02; F42B 1/00; F42D 1/02; E21B 43/117

See application file for complete search history.

(56) References Cited

U.S. PATENT DOCUMENTS

| | | | | | |
|---|---|---|---|---|---|
| 3,013,491 | A * | 12/1961 | Poulter | F42B 12/14 | 102/318 |
| 4,753,170 | A * | 6/1988 | Regalbuto | F42D 1/04 | 102/305 |
| 4,844,170 | A * | 7/1989 | Gill | E21B 43/119 | 175/4.51 |
| 6,619,176 | B2 * | 9/2003 | Renfro | F42B 1/028 | 102/307 |
| 7,997,203 | B1 * | 8/2011 | Macri | F42C 19/06 | 102/202.5 |
| 10,151,180 | B2 * | 12/2018 | Robey | E21B 43/117 | |
| 2002/0078850 | A1 * | 6/2002 | Renfro | F42B 1/028 | 102/476 |

(Continued)

FOREIGN PATENT DOCUMENTS

| | | | |
|---|---|---|---|
| EP | 0925423 | A1 | 6/1999 |
| WO | 9322610 | A1 | 11/1993 |

(Continued)

*Primary Examiner* — Jonathan C Weber

(74) *Attorney, Agent, or Firm* — Jeffrey D. Frantz

(57) ABSTRACT

A charge canister for a perforation tool has a cylindrical body with an expansion portion extending along a radius of the cylindrical body, the expansion portion having a narrow portion at a first end of the expansion portion and a wide portion at a second end of the expansion portion opposite from the first end. An explosive material is disposed within the expansion portion in direct contact with an interior surface thereof.

20 Claims, 4 Drawing Sheets

(56) References Cited

U.S. PATENT DOCUMENTS

| | | | | |
|---|---|---|---|---|
| 2003/0037692 | A1 | 2/2003 | Liu | |
| 2014/0310940 | A1 | 10/2014 | Grattan | |
| 2015/0292306 | A1* | 10/2015 | Collins | E21B 43/116 102/306 |
| 2017/0145798 | A1* | 5/2017 | Robey | E21B 43/117 |
| 2019/0310056 | A1 | 10/2019 | Loehken et al. | |

FOREIGN PATENT DOCUMENTS

| | | | | |
|---|---|---|---|---|
| WO | WO-0192674 | A2 * | 12/2001 | B22F 1/0003 |
| WO | WO-2015179713 | A1 * | 11/2015 | E21B 3/117 |
| WO | WO-2015184323 | A1 * | 12/2015 | E21B 3/117 |
| WO | WO-2016161376 | A1 * | 10/2016 | E21B 3/119 |
| WO | WO-2020023774 | A1 * | 1/2020 | E21B 43/117 |

* cited by examiner

SHAPED CHARGE INTEGRATED CANISTER

CROSS-REFERENCE TO RELATED APPLICATIONS

This patent application claims benefit of U.S. Provisional Patent Application Ser. No. 63/160,426 filed Mar. 12, 2021, which is entirely incorporated herein by reference.

FIELD

Perforation tools and components used in hydrocarbon production are described herein. Specifically, charge-integrated loading tubes and perforation tools employing such loading tubes are described herein.

BACKGROUND

Perforation tools are tools used in oil and gas production to form holes, passages, and/or fractures in hydrocarbon-bearing geologic formations to promote flow of hydrocarbons from the formation into the well for production. The tools generally have explosive charges shaped to project a jet of reaction products, including hot gases and molten metal, into the formation. Typically, the tool has a generally tubular profile, and includes support frames, ignition circuits, and potentially wiring for activating the charges and communicating signals and/or data along the tool. The charges are generally shaped like a cone or a bell, and the charges are generally activated by delivering energy, such as thermochemical energy and/or electrical energy, to an apex region of the charge.

The shaped charges conventionally used have a casing to hold explosive material, the explosive material pressed into the casing, and a liner pressed onto the explosive material to retain the explosive material and protect the explosive material from the environment. The shaped charges are installed into a frame that has retention features to secure the shaped charge within the frame. Installing and removing shaped charges from frames lengthens assembly time for perforation tools and increases cost and complexity of shaped charge frames. Improved shaped charge perforation tools are needed.

SUMMARY

Embodiments described herein provide a charge canister for a perforation tool, the charge canister comprising a cylindrical body having an expansion portion extending along a radius of the cylindrical body, the expansion portion having a narrow portion at a first end of the expansion portion and a wide portion at a second end of the expansion portion opposite from the first end; and an explosive material disposed within the expansion portion in direct contact with an interior surface thereof.

Other embodiments described herein provide a perforation tool, comprising a tubular housing; an initiation module disposed within the housing, the initiation module comprising a detonator housing protruding from an end of the initiation module for housing a detonator; and a charge canister disposed within the housing, the charge canister comprising a cylindrical body an expansion portion extending along a radius of the cylindrical body, the expansion portion having a narrow portion at a first end of the expansion portion and a wide portion at a second end of the expansion portion opposite from the first end; and an explosive material disposed within the expansion portion in direct contact with an interior surface thereof.

Other embodiments described herein provide a method of making a charge canister for a perforation tool, the method comprising disposing an explosive mixture into an expansion portion of a charge canister, the charge canister comprising a cylindrical body having the expansion portion extending along a radius of the cylindrical body, the expansion portion having a narrow portion at a first end of the expansion portion and a wide portion at a second end of the expansion portion opposite from the first end, the explosive material in direct contact with an interior surface of the expansion portion; disposing a liner against the explosive material within the expansion portion; and pressing the liner against the explosive material to set the explosive material and the liner into the expansion portion.

DETAILED DESCRIPTION

The perforation tools described herein use charge canisters that have explosive material integrated into the canister so that charges do not need to be attached and detached from a frame. In one category, canisters described herein have a cylindrical body with a central passage along an axis thereof, and one or more expansion portions formed in the cylindrical body. Each expansion portion has a narrow portion disposed near the central passage and extends radially outward from the central passage to a wide portion. The narrow portion of each expansion portion has an opening that provides fluid communication with the central passage. Explosive material is integrated into each expansion portion in direct contact with an interior surface of the expansion portion, without the use of a casing or other body to carry the explosive material. In another category, canisters described herein do not have a central passage. In such canisters the expansion portions extend substantially from one side of the cylindrical body to the opposite side, such that the axis of the cylindrical body is between the narrow portion and the wide portion of each expansion portion.

The explosive material of the canisters described herein cannot be removed as a modular unit. For example, these canisters do not have self-contained modular shaped charges that can be installed and removed. The explosive material is integrally disposed within the canister in a way that the explosive material becomes an unremovable component of the canister. Such construction simplifies use of perforation tools because installation of shaped charges into the canister is not needed. The canister is just assembled with an initiator module, and optionally with a seal module, to yield a perforation tool.

Figure 1:
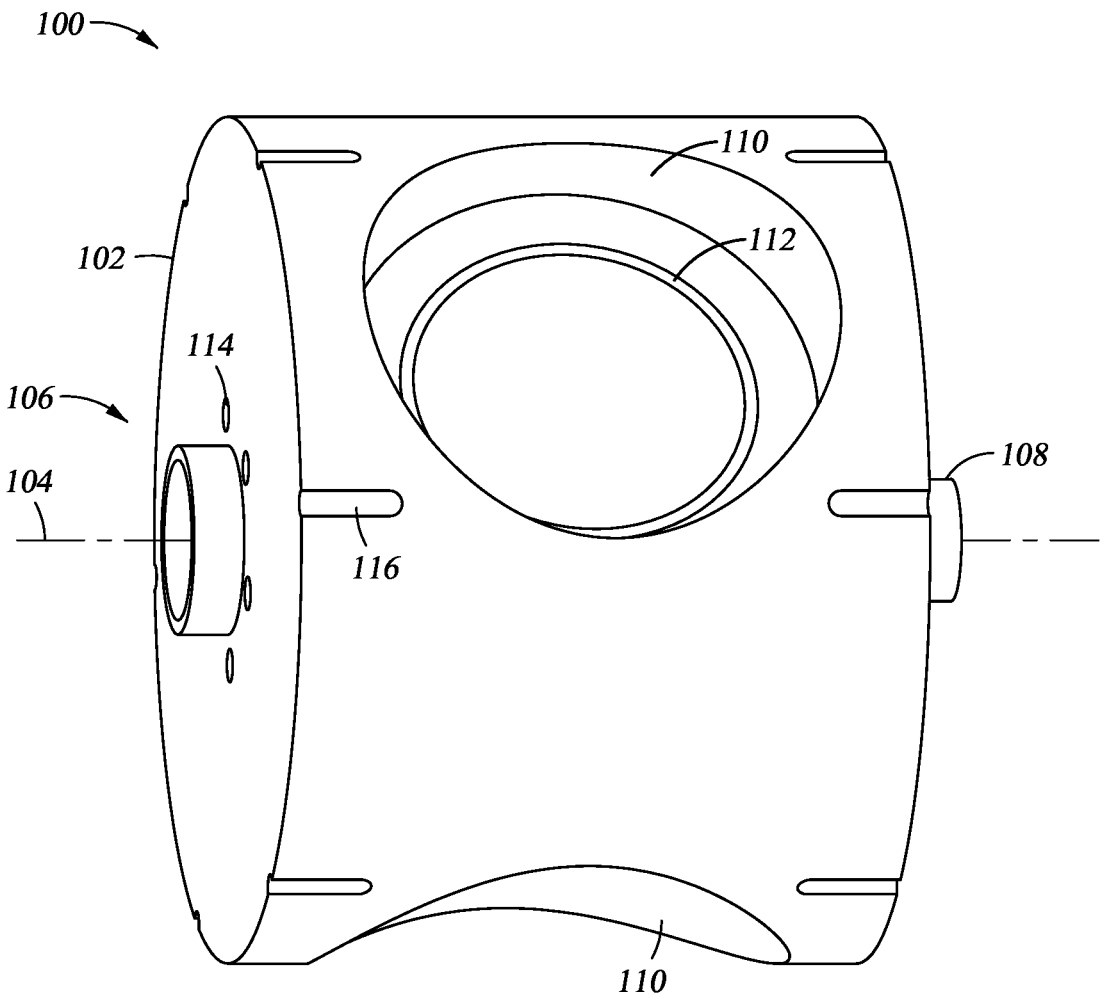
FIG. 1 is a perspective view of a charge canister according to one embodiment.

FIG. 1 is a perspective view of a charge canister 100 according to one embodiment. The charge canister 100 has a cylindrical body 102 with a central axis 104 and a central passage 106 through the cylindrical body 102 along the central axis 104. The central passage 106 accommodates an electrical conductor 108, which is a cylindrical body that, in this case, contacts an interior wall of the central passage 106 around the entire circumference of the electrical conductor 108. The electrical conductor 108 is tubular, with a central passage of its own to accommodate a booster charge or other ballistic transfer device. The electrical conductor 108 is formed with a "male" end and a "female" end, when installed in the charge canister 100 the male and female ends located at opposite ends of the cylindrical body 102. The male and female ends of the electrical conductor 108 facilitate physical and electrical connection with another similar electrical conductor of another module. When the charge canister 100 is deployed in a perforation tool, the electrical conductor 108 will engage physically and electrically with another electrical conductor of another module, as further described below. The electrical conductor 108 is inserted into the central passage 106 until the female end contacts the cylindrical body 102. In that position, both the male and female ends of the electrical conductor 108 may protrude from opposite ends of the cylindrical body 102. The electrical conductor 108 can be secured within the central passage 106 by using a fastening feature, such as a snap ring or other device, at the male end of the electrical conductor 108.

It should be noted that in other embodiments, the electrical conductor 108 might not contact the inner wall of the central passage 106 around its entire circumference. For example, the central passage 106 may be formed with axial ridges that maintain a space between the outer wall of the electrical conductor 108 and the inner wall of the central passage 106.

The cylindrical body 102 has at least one expansion portion 110. The expansion portion 110 is generally radially symmetric and extends along a radius of the cylindrical body 102 from a narrow portion, at a first end of the expansion portion 110, to a wide portion, at a second end of the expansion portion 110 opposite from the first end. In some cases, the expansion portion 110 can extend along an axis of radial symmetry of the expansion portion 110 that is angled with respect to a radius of the cylindrical body 102. The narrow portion of the expansion portion 110 is adjacent to the central passage 106 of the cylindrical body 102. There can be any number of expansion portions 110, which can be disposed in the same transvers plane of the cylindrical body 102 or can be displaced along the axis of the cylindrical body 102 in any convenient way. The expansion portion, or portions 110, are thus generally conical in shape or cup-shaped with a linear or monotonically curved profile, the profile being continuous or discontinuous.

At the narrow portion of the expansion portion 110 is an opening (not shown) that provides fluid communication between the interior of the central passage 106 and an interior of the expansion portion 110. The opening transmits ballistic energy from the central passage 106, for example from a booster charge or other ballistic device located within the central passage 106, to the interior of the expansion portion 110. A primer may be located in the opening to ensure ballistic energy reaches the interior of the expansion portion 110. The central passage 106 thus extends between the expansion portions 110 of the cylindrical body 102 with the narrow ends of the expansion portions 110 adjacent to the central passage 106 and the expansion portions 110 extending radially outward from the central passage 106, and the narrow ends adjacent thereto, to the wide ends of the expansion portions.

Two expansion portions 110 are visible in FIG. 1, located generally along the same transverse plane of the cylindrical body 102. Any number of expansion portions 110 may be provided in the charge canister 100. The expansion portions 110 are generally uniformly distributed around the cylindrical body 102, with uniform azimuthal distribution. Here, the expansion portions 110 are arranged in coplanar fashion along one plane perpendicular to the central axis 104. In other cases, the expansion portions 110 may be distributed along the central axis 104, and a mixture of coplanar and axially distributed expansion portions may be used in some cases.

The expansion portions 110 have no retention features for holding shaped charges. The interior surface of the expansion portions 110 are generally smooth, and the wide portion of each expansion portion 110 has a smooth rim, with no retention feature for holding a shaped charge. A liner 112 is disposed within the expansion portion 110. The liner 112 is pressed into the expansion portion 110 and holds an explosive material (not shown in FIG. 1) within the expansion portion 110. The liner 112 is typically secured into the expansion portion 110 using an adhesive material or an adhering device. The interior surface of the expansion portions 110 may have a surface treatment to enhance adhesion of the explosive material to the interior surface. The surface treatment may include applying an adhesive or may include creating a roughness, for example by sand blasting, scoring, abrading, and the like. Pressing the explosive material into the interior surface of the expansion portions 110 results in adhesion of the explosive material to the interior surfaces. Where an adhesive is applied to the interior surface the adhesive is generally applied in a way that does not obstruct the opening at the narrow portion of the expansion portion.

The liner 112 is a conical or dome-shaped object with a rim and an apex. The apex is typically pressed into the explosive material, and the rim generally contacts the interior surface of the expansion portion 110 when pressed down onto the explosive material. The liner 112 may be secured by applying an adhesive to the rim before pressing into the explosive material so that when the liner 112 contacts the interior surface, the adhesive holds the liner 112 in place. Alternately, a retention feature, such as a groove, tab, ledge, or other suitable feature may be provided at the interior surface of the expansion portion 110 to capture the rim of the liner 112.

The cylindrical body 102 may have alignment features for setting the direction of the expansion portions 110 and/or for aligning the charge canister 100 with other modules. A first alignment feature 114 is located at an end of the cylindrical body 102 for aligning the charge canister 100 with another module in a downhole tool assembly such as a perforation tool. Here, the first alignment feature 114 is a plurality of recesses, but any convenient configuration can be used, such as bumps, ridges, grooves, textured surfaces, and the like. The recesses of the first alignment feature 114 would engage with matching bumps on another module to align the charge canister 100 with the module. Note that here the plurality of recesses facilitates an adjustable alignment between the charge canister 100 and another module. A similar alignment feature may be provided on the opposite end of the cylindrical body 102 (not visible in FIG. 1).

A second alignment feature 116 is shown on a side of the cylindrical body 102 for aligning the charge canister 100 within a housing, for example a housing of a perforation tool. The second alignment feature 116 is configured here as a plurality of grooves formed in the external surface of the side of the cylindrical body 102, the grooves extending in the direction of the central axis 104. The grooves can engage with matching ridges formed on an interior surface of a housing for accepting the charge canister 100, such that the charge canister 100 can be disposed in a desired alignment within the housing. A plurality of the grooves, and matching ridges, can be provided for adjustable alignment. The second alignment feature 116 can take any convenient form, such as grooves, ridges, tabs, and the like, but will typically allow the charge canister 100 to be moved within the housing in an axial direction for installation and removal. Here, the second alignment feature 116 is formed at both ends of the charge canister 100 to facilitate insertion into a housing in either axial orientation (either end can be inserted first into the housing).

The cylindrical body 102 is shown here as a homogeneous, monolithic, member. Generally, the cylindrical body 102 is a structurally strong member capable of withstanding the rigors of downhole detonation. The cylindrical body 102 may be made of metal, for example steel, or another hard material such as a hard plastic. The cylindrical body may be a combination of steel and plastic. For example, a plastic cylindrical body may have steel inserts in the expansion portions thereof to support application of high pressure to set the explosive material and liners. Where the inner wall of the central passage 106 is metal, an insulator may be used between the electrical conductor 108 and the central passage 106. The insulator may be a coating on the outside of the electrical conductor 108, a coating on the inner wall of the central passage 106, or a separate member inserted into the central passage 106 between the inner wall of the central passage 106 and the electrical conductor.

The charge canister 100 is shown with expansion portions 110 that are recesses within the cylindrical body 102. In another embodiment, the charge canister can be a substantially tubular body with expansion bells extending radially outward from the tubular body as expansion portions. Such a charge canister can be a single metal piece with a hollow tubular portion for electrical and ballistic conductivity, the expansion bells having openings at the narrow ends thereof to provide fluid communication with the interior of the tubular portion. Such a charge canister can be overmolded with plastic, if desired, to form alignment features.

Figure 2:
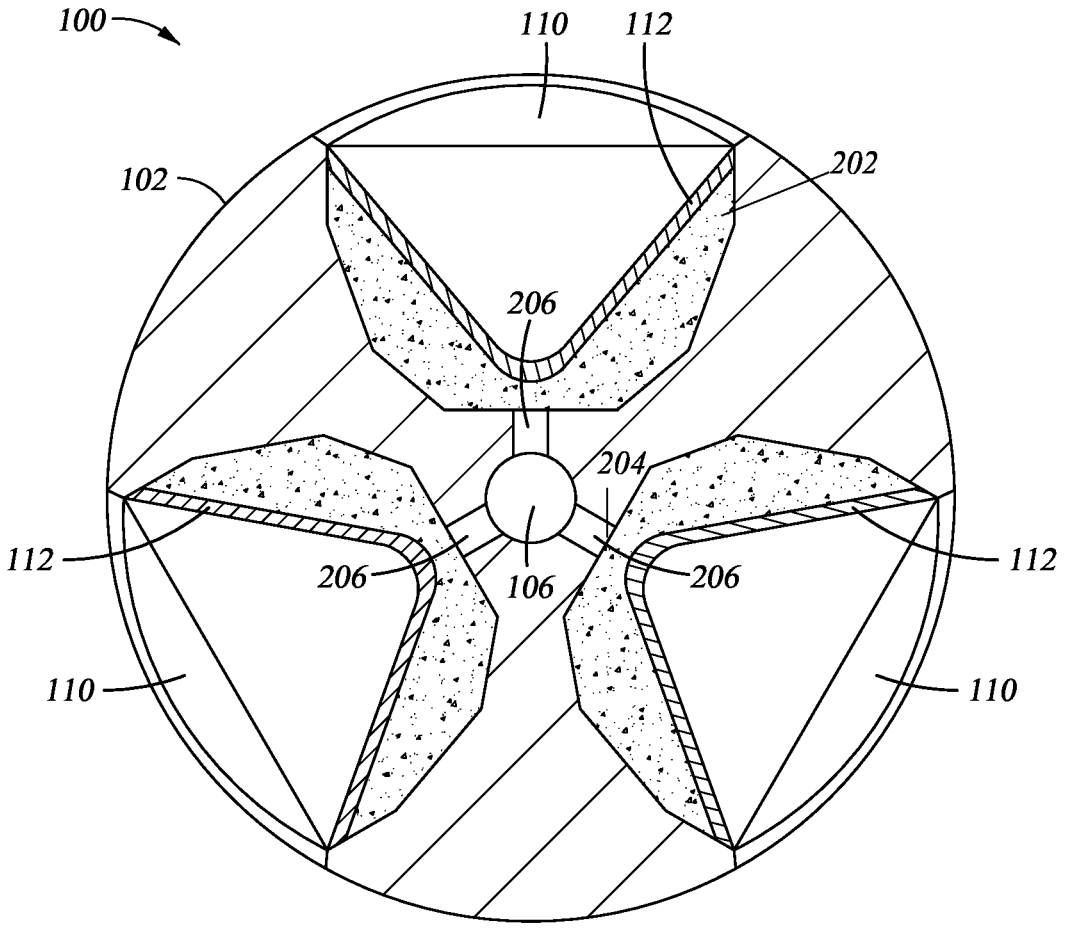
FIG. 2 is a cross-sectional view of the charge canister of FIG. 1.

FIG. 2 is a cross-sectional view of the charge canister 100. As described above, an explosive material 202 is disposed in the expansion portion 110 in direct physical contact with an interior surface thereof. The explosive material 202 is pressed between the liner 112 and the interior surface of the expansion portion 110. The liner 112 and the interior surface of the expansion portion 110 are shaped to mold the explosive material 202 into a desired shape for projecting an optimized jet of material outward from the expansion portion 110 into a subterranean formation. The liner 112 is also in direct physical contact with the interior surface of the expansion portion 110 to hold the explosive material 202 securely by adhering to the interior surface. As noted above, a retention feature can also be provided to secure the liner 112.

A thin wall 204 at the narrow end of the expansion portion 110 separates the interior of the expansion portion 110 from the interior of the central passage 106. A booster material is disposed within the central passage 106, adjacent to the narrow end of the expansion portion 110, to provide ballistic energy that penetrates through the wall 204 into the expansion portion 110 to discharge the explosive material 202. A primer 206 may be disposed at the narrow end of the expansion portion 110, adjacent to the wall 204, to amplify the ballistic energy transfer from the central passage 106. The booster material may be a booster charge or a detonation cord. Where a booster charge is used, the electrical conductor (not shown in FIG. 2) may have an interior circumferential ridge to position the booster charge adjacent to the wall 204. The wall 204 has a thickness sufficient to provide support during insertion and fixing of the explosive material 202 and the liner 112 within the expansion portion 110. Alternately, a small pinhole may be provided in the wall 204, so long as the wall 204 retains enough strength to support the explosive material 202 and the liner 112 during fixing in the expansion portion 110.

Figure 3:
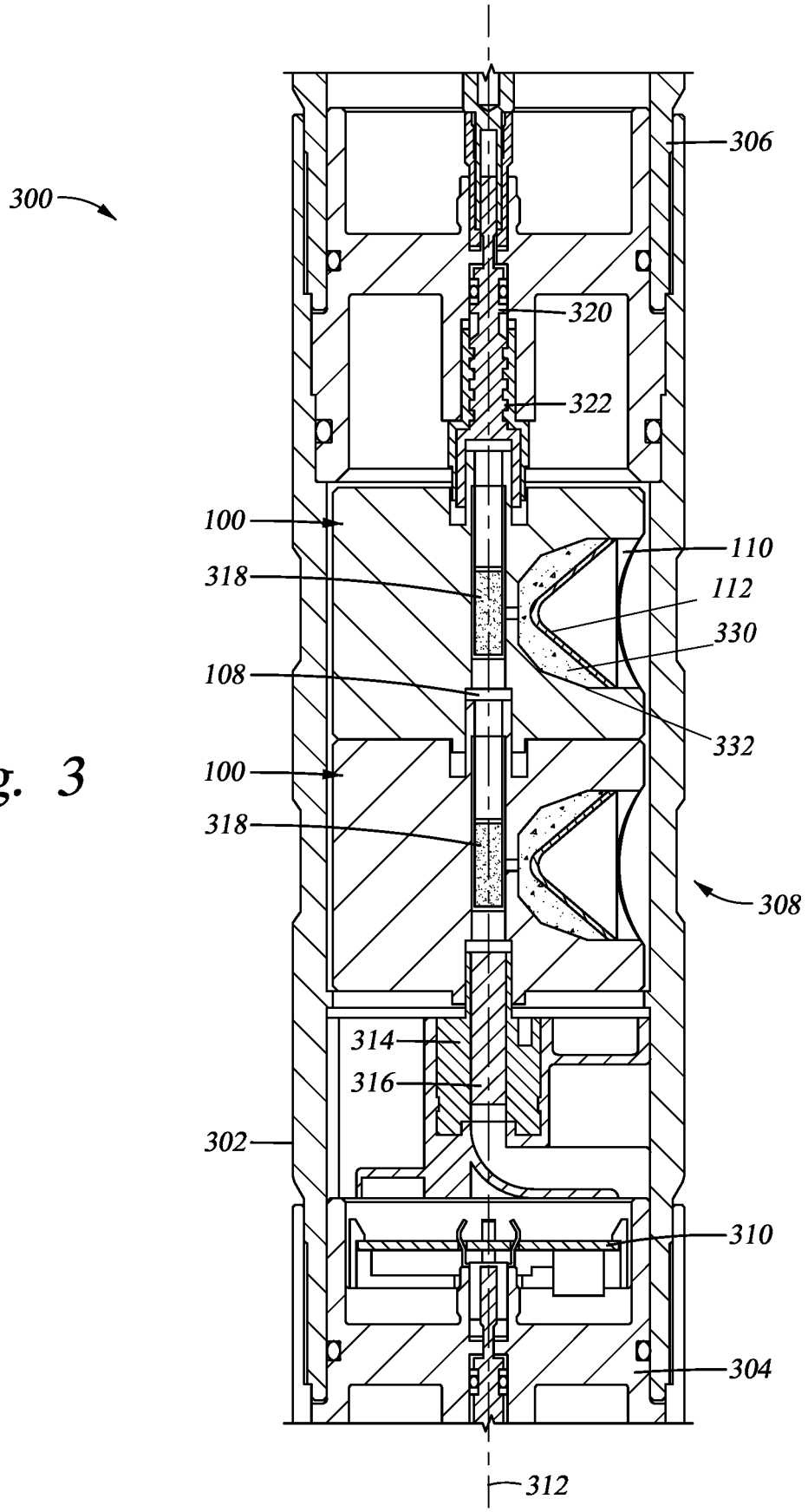
FIG. 3 is a cross-sectional view of a perforation tool, according to one embodiment.

FIG. 3 is a cross-sectional view of a perforation tool 300 according to one embodiment. The perforation tool 300 has a housing 302 that contains an initiation module 304, a bulkhead module 306, and one or more of the charge canisters 100. Two canisters 100 are shown in the perforation tool 300, but any number can be installed in a housing 302. The housing 302 has grooves 308 formed in an external surface of the housing. The grooves 308 are formed, in this case, around the entire circumference of the housing 302. The grooves 308 provide a thin wall section to promote penetration of the perforation jet through the housing 302 upon activation of the charges. The housing 302 may have positioning features, such as ridges or tabs protruding radially inward from the inner wall of the housing 302, to aid in positioning the charge canisters 100 with the expansion portions 110 adjacent to the grooves 308.

The initiation module 304 has an initiation circuit 310, in this case positioned in an orientation transverse to a central axis 312 of the perforation tool 300. The central axis 312 of the perforation tool 300 aligns with the central axis 104 of the charge canisters 100 in this case, but the modules could be configured to provide an offset of the central axis 104 from the central axis 312. The initiation circuit 310 is electrically coupled to a detonator 316 disposed in a detonator housing 314 of the initiation module 304. The detonator housing 314, and detonator 316, may protrude from an end of the initiation module 304 into the end of a charge canister 100 to provide ballistic discharge into the interior of the electrical conductor 108. A booster 318 is disposed within the electrical conductor 108 of each charge canister 100. The electrical conductors 108 of the charge canisters engage by male/female connection to provide a continuous fluid pathway along the central passages 106 of the charge canisters 100.

The bulkhead module 306 is disposed within the housing 302, with the charge canisters 100 between the bulkhead module 306 and the initiation module 304. The bulkhead module 306 has a central passage 320, similar to the charge canisters 100, with a bulkhead electrical conductor 322 disposed therein. The bulkhead electrical conductor 322 has a female end that engages with a male end of an electrical conductor 108 of a charge canister 100 to provide electrical continuity from the charge canisters 100 to the bulkhead module 306. The electrical conductor 322 conducts electricity from the end of the bulkhead module 306 near the charge canister 100 to the opposite end of the bulkhead module 306 to provide electrical continuity for the charge canister 100.

As described above in connection with FIG. 1, the canisters 100 have an explosive material 330 disposed in the expansion portions 110 thereof in direct contact with an interior surface 332 of the expansion portion. The liner 112 is in direct contact with the explosive material 330 and with the interior surface 332 of the expansion portion 110. The liner is secured by adhesion, or other retention device, within the expansion portion 110.

The embodiments described herein include a method of making a charge canister for a perforation tool. An explosive mixture is disposed into an expansion portion of a cylindrical body. The cylindrical body may have one expansion portion or a plurality of expansion portions. The expansion portion is a bell-shaped, or generally expansion-shaped, body or recess with an interior for accepting the explosive mixture. The expansion portion has a narrow portion at a first end thereof and a wide portion at a second end thereof, opposite from the first end. The explosive mixture is deployed through the wide end to the narrow end of the expansion portion and rests in direct physical contact with the interior surface of the expansion portion at the narrow end thereof. The cylindrical body, with expansion portion, may be according to any of the embodiments described herein.

A liner is disposed in the expansion portion in direct physical contact with the explosive mixture and with the interior surface of the expansion portion. The liner is then pressed, using high pressure such as 40,000 psi, into the expansion portion against the explosive material. The explosive material is pressed against the interior surface of the expansion portion, and is held in place by adhering, of otherwise securing, the liner to the interior surface of the expansion portion. The explosive material may contain a binder material that can enhance adhesion of the explosive material to the interior surface, and the interior surface can be provided with a texture, for example a roughening, grooving, abrasion, scratching, or the like to enhance adhesion.

The liner and interior surface of the expansion portion are shaped to mold the explosive material into a desired shape with a volume defined between the liner and the interior surface to provide an optimized jet of combustion products and liner material outward from the wide end of the expansion portion into a subterranean formation.

The cylindrical body includes a central passage adjacent to the narrow end of the expansion portion. An opening is provided at the narrow end of the expansion portion for fluid communication between the central passage and the interior of the expansion portion. Ballistic energy is provided in the central passage, and flows through the opening to the explosive material disposed in the interior of the expansion portion to discharge the explosive material.

Figure 4:
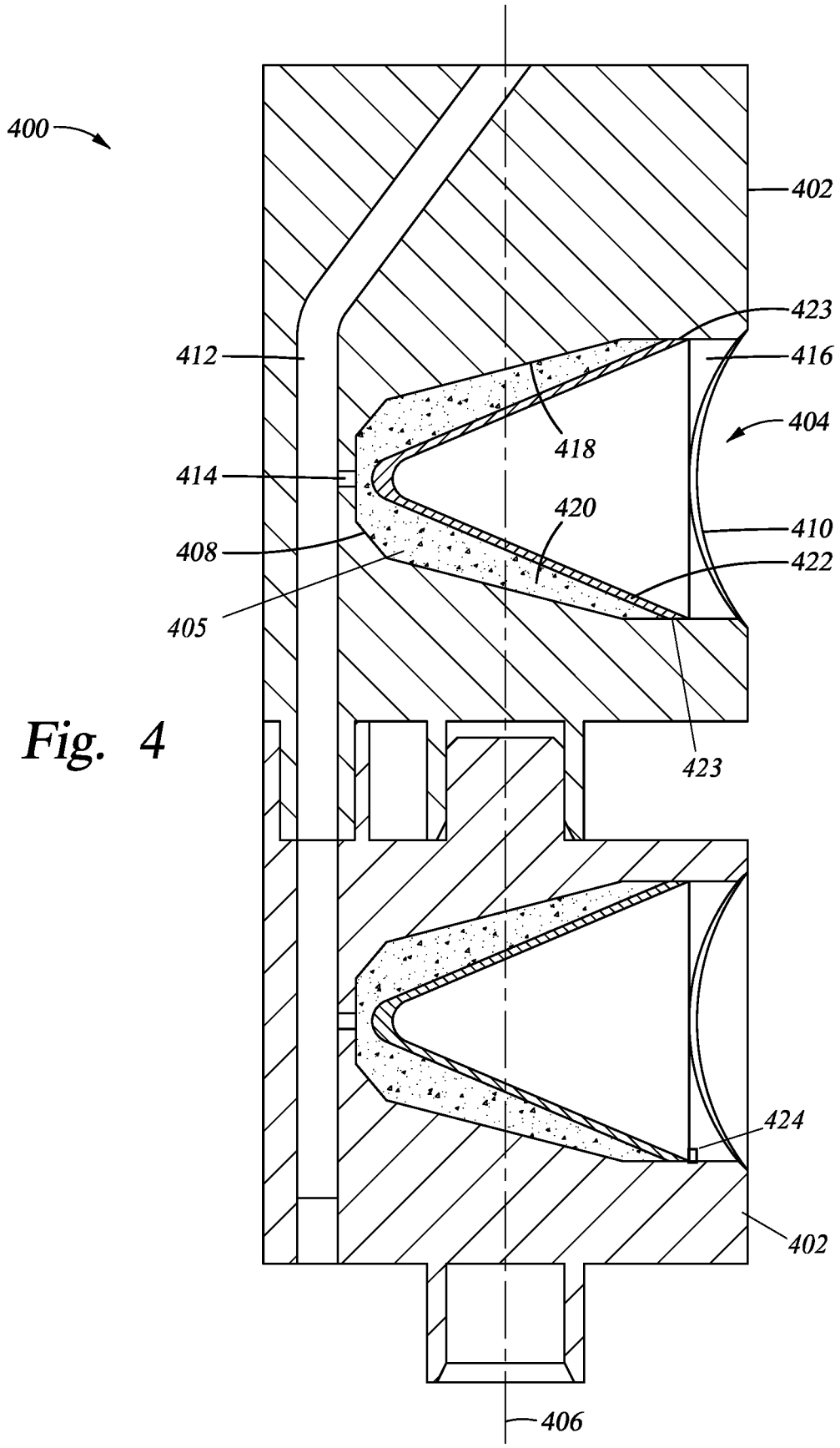
FIG. 4 is a cross-sectional view of a charge canister according to another embodiment.

FIG. 4 is a cross-sectional view of a shaped charge canister 400 according to another embodiment. The canister 400 uses large shaped charges that extend across the canister 400 from side to side, with no central passage. The shaped charge canister 400 is also modular, comprising a plurality of frames 402 that hold shaped charges, each frame 402 holding one charge. Two frames 402 are shown here, but the canister 400 could have one frame 402, three frames 402, or more, in concept without limit. Each frame 402 has an expansion portion 404 that holds a shaped charge 405. The shaped charge canister 400 is a generally cylindrical body, and each frame 402 has a generally cylindrical profile. The canister 400 has a central axis 406 that is an axis of the cylindrical shape of the canister 400.

Each expansion portion 404 has a narrow portion 408 at a first end of the expansion portion 404 and a wide portion 410 at a second end of the expansion portion 404 opposite from the first end. The expansion portion 404 expands in width from the narrow portion 408 to the wide portion 410, providing a recess to house the shaped charge 405. The central axis 406 is between the narrow portion 408 and the wide portion 410 of each expansion portion 404. A ballistic transfer device 412 is disposed near the narrow portion 408 to provide ballistic discharge to detonate explosive material of the shaped charge 405. A port 414 at the narrow portion 408 provides fluid communication from the ballistic transfer device 412 into the expansion portion 404 to detonate the explosive material.

Explosive material 420 is disposed in direct contact with an interior surface 418 of the expansion portion 404. A liner 422 is disposed in the expansion portion 404. An outer surface of the liner 422, together with the interior surface 418 of the expansion portion 404 defines a space into which the explosive material 420 is disposed. The liner 422 is thus in direct contact with the explosive material 420, which in turn is also in direct contact with the interior surface 418. The liner 422 comes into direct contact with the interior surface 418 at a rim area 416 of the interior surface 418, which is near the wide portion 410. The liner 422 may be secured using adhesive to attach the liner 422 to the interior surface 418 at the rim area 416. Securing the liner 422 in the expansion portion 404 also secures the explosive material 420 between the liner 422 and the interior surface 418. The liner 422 may have a flat rim surface 423 substantially parallel to the rim area 416 to enhance adhesion. The contact area between the liner 422 and the rim area 416 can be selected to provide a specified amount of adhesion.

One of the expansion portions 404 is shown here with a retention feature 424 that can be used to secure the liner 422 within the expansion portion 404. This retention feature 424 is shown to illustrate the idea of using a retention feature instead of, or in addition to, using an adhesive to secure the liner within the expansion portion. Thus, the two expansion portions 404 shown in FIG. 4 are different since one has a retention feature and the other does not. The canister 400 can have expansion portions that are different, as shown here, or all expansion portions 404 can be the same, with or without retention features.

The retention feature 424 can be a ledge, tab, or groove that engages with the rim of the liner 422 to hold the liner 422 within the expansion portion 404. The retention feature 424 extends at least partway around the circumference of the rim area 416, and may extend entirely around the circumference of the rim area 416. A combination of protrusions, such as ledges and tabs, with recessions, such as grooves, can be used. In some embodiments, more than one set of retention features can be provided at different depths on the interior surface 418.

The liner 422 can have a barrier film to minimize unwanted interaction between the liner material and the explosive material. The barrier film is usually applied as a coating to the contact surface of the liner 422. The barrier film may be applied over the entire convex surface of the liner 422, including the rim portion that contacts the interior surface 418 of the expansion portion 404, or the barrier film can be applied over only a portion of the convex surface, as appropriate. The barrier film is made of a material that can adhere to the liner surface and is substantially non-reactive or inert with respect to the explosive material.

The interior surface 418 has a surface preparation that enhances adhesion of the explosive material 420 to the interior surface 418. The surface preparation may include, or be, a texture, scoring, abrasion, grooving, adhesive application, or any surface preparation, or combination of surface preparations that can enhance adhesion.

To prepare the shaped charge canisters described herein, a blank canister is obtained that has expansion portions with interior surfaces that can be used to contact, and adhere with, an explosive material. The interior surface of each expansion portion to be loaded is prepared by applying a texture or roughness, or an adhesive, or combination thereof to the surface. Texturing can be performed by blasting, for example sand blasting, abrading, scouring, scratching, grooving, or any combination thereof that results in a randomized textured interior surface. Adhesive can be applied to the entire interior surface or to a portion of the interior surface. Generally speaking, the surface preparation is performed in a way that avoids compromising the port at the narrow portion of the expansion portion to avoid reducing or occluding fluid communication to the ignition source.

Suitable explosive materials are those commonly used in shaped charges, containing an explosive component and a binder in a paste-like composition that can be shaped using pressure. Alternately, the explosive material, with binder, might have a powder-like consistency, or may be a pellet. A ball, or mass of any shape (such as a pellet), of the explosive material is disposed within the expansion portion or portions to be loaded. The explosive material may be shaped or spread by hand, or using a tool. A liner is then pressed into the explosive material to promote adhesion of the explosive material with the interior surface.

As noted herein throughout, the liner has a rim portion that directly contacts the interior surface at a rim area thereof. The rim portion of the liner may be prepared for optimal engagement with the rim area by providing a flat contact area and/or by applying an adhesive. Additionally, or alternately, adhesive may be applied to the rim area of the interior surface where contact with the liner is to be made. When the liner is pressed into the expansion portion containing the explosive material, the explosive material spreads to conform to the volume between the liner and the interior surface. If retention features are used, the liner is pressed into the expansion portion until the retention features engage. If adhesive is used, the liner will be pressed into the expansion portion until the adhesive sets enough to secure the liner in place.

It should be noted that where a retention feature is used to secure the liner into the expansion portion, adhesion of the explosive material to the interior surface of the expansion portion is not as important since the liner will hold the explosive material in the volume between the liner and the interior surface. In such cases, little or no adhesion of the explosive material to the interior surface is needed. As described herein, the expansion portions of the canisters can have retention features or can be free of retention features.

The shaped charge canisters described herein simply field preparation of perforation tools. Charges are pre-loaded into the canisters so the charges do not need to be installed in the field. Ballistic transfer devices and electrical continuity devices can also be pre-installed so the canister is ready to be connected into a perforation tool upon arrival in the field. The perforation tool is assembled by connecting one or more of the canisters described herein with other tool modules, such as initiators and seal members. Because the canisters are already loaded, time consuming steps of installing charges and connecting electrical and ballistic elements can be skipped.

While the foregoing is directed to embodiments of the present invention, other and further embodiments of the present disclosure may be devised without departing from the basic scope thereof, and the scope thereof is determined by the claims that follow.

We claim:

1. A charge canister for a perforation tool, the charge canister comprising:

a cylindrical body having an expansion portion extending along a radius of the cylindrical body, the expansion portion having a randomized textured interior surface, a narrow portion at a first end of the expansion portion, and a wide portion at a second end of the expansion portion opposite from the first end; and an explosive material disposed within the expansion portion in direct contact with the randomized textured interior surface of the expansion portion.

2. The charge canister of claim 1, wherein the wide portion of the expansion portion is free of retention features.

3. The charge canister of claim 2, further comprising a liner disposed in the expansion portion and covering the explosive material.

4. The charge canister of claim 3, wherein the liner is secured using an adhesive.

5. The charge canister of claim 3, wherein the liner is secured by engagement of an edge of the liner with a retention feature of the randomized textured interior surface of the expansion portion.

6. The charge canister of claim 3, wherein the cylindrical body has a central passage disposed along an axis thereof and the first end of the expansion portion is adjacent to the central passage.

7. The charge canister of claim 3, wherein the liner has a barrier coating.

8. The charge canister of claim 1, wherein the randomized textured interior surface is a roughened surface configured to enhance adhesion of the explosive material to the roughened surface.

9. The charge canister of claim 1, wherein the cylindrical body is a homogeneous, monolithic cylindrical body.

10. A perforation tool, comprising:

a tubular housing;

an initiation module disposed within the tubular housing, the initiation module comprising a detonator housing protruding from an end of the initiation module for housing a detonator; and a charge canister disposed within the tubular housing, the charge canister comprising:

a cylindrical body having an expansion portion extending along a radius of the cylindrical body, the expansion portion having a randomized textured interior surface, a narrow portion at a first end of the expansion portion and a wide portion at a second end of the expansion portion opposite from the first end; and an explosive material disposed within the expansion portion in direct contact with the randomized textured interior surface of the expansion portion.

11. The perforation tool of claim 10, wherein the expansion portion of the charge canister is free of retention features.

12. The perforation tool of claim 10, further comprising a liner disposed in the expansion portion and covering the explosive material.

13. The perforation tool of claim 12, wherein the liner is secured using an adhesive.

14. The perforation tool of claim 12, wherein the liner is secured by engagement of an edge of the liner with a retention feature of the randomized textured interior surface of the expansion portion.

15. The perforation tool of claim 12, wherein the cylindrical body has an additional central passage disposed along an axis thereof and the first end of the expansion portion is adjacent to the additional central passage.

16. The perforation tool of claim 12, wherein the liner has a barrier coating.

17. The perforation tool of claim 10, wherein an adhesive material is used to enhance adhesion of the explosive material to the randomized textured interior surface of the expansion portion, wherein the randomized textured interior surface is a roughened interior surface.

18. The perforation tool of claim 10, further comprising a bulkhead module disposed within the tubular housing, the bulkhead module comprising a central passage and an electrical conductor disposed within the central passage, wherein the electrical conductor is configured to provide electrical continuity from the charge canister to the bulkhead module, and wherein the charge canister is positioned axially between the initiation module and the bulkhead module.

19. A method of making a charge canister for a perforation tool, the method comprising:

applying a randomized surface preparation to an interior surface of an expansion portion of a cylindrical body, wherein the randomized surface preparation comprises texturing the interior surface to provide a randomized textured interior surface prior to disposing an explosive material into the expansion portion;

disposing the explosive material into the expansion portion of the cylindrical body, the cylindrical body having the expansion portion extending along a radius of the cylindrical body, the expansion portion having a narrow portion at a first end of the expansion portion and a wide portion at a second end of the expansion portion opposite from the first end, the explosive material in direct contact with the randomized textured interior surface of the expansion portion;

disposing a liner against the explosive material within the expansion portion; and pressing the liner against the explosive material to set the explosive material and the liner into the expansion portion.

20. The method of claim 19, further comprising securing the liner to the randomized textured interior surface of the expansion portion using an adhesive material.

* * * * *